US008863440B1

(12) United States Patent
Champlin

(10) Patent No.: US 8,863,440 B1
(45) Date of Patent: Oct. 21, 2014

(54) FORCE-RESISTANT PANEL

(71) Applicant: Therm-O-Lite, Inc., South Bend, IN (US)

(72) Inventor: Richard Champlin, South Bend, IN (US)

(73) Assignee: Therm-O-Lite, Inc., South Bend, IN (US)

( * ) Notice: Subject to any disclaimer, the term of this patent is extended or adjusted under 35 U.S.C. 154(b) by 0 days.

(21) Appl. No.: 14/283,853

(22) Filed: May 21, 2014

Related U.S. Application Data

(60) Provisional application No. 61/825,574, filed on May 21, 2013.

(51) Int. Cl.

| | |
|---|---|
| ***E06B 5/12*** | (2006.01) |
| ***E05G 1/024*** | (2006.01) |
| ***E05G 1/026*** | (2006.01) |
| ***E06B 5/10*** | (2006.01) |
| ***F41H 5/26*** | (2006.01) |

(52) U.S. Cl.
CPC *F41H 5/26* (2013.01); *E05G 1/024* (2013.01); *E05G 1/026* (2013.01); *E06B 5/10* (2013.01); *Y10S 52/04* (2013.01)
USPC ..... 52/1; 52/204.53; 52/208; 52/DIG. 4

(58) Field of Classification Search
CPC ..... E04B 1/98; E04B 5/12
USPC ..... 52/1, 204.53, 208, DIG. 4
See application file for complete search history.

(56) References Cited

U.S. PATENT DOCUMENTS

| | | | | |
|---|---|---|---|---|
| 4,561,223 | A * | 12/1985 | Gold et al. | 52/202 |
| 7,383,666 | B2 * | 6/2008 | Coddens | 52/204.62 |
| 8,151,525 | B2 * | 4/2012 | Coddens | 52/204.62 |
| 8,590,227 | B2 * | 11/2013 | Coddens | 52/204.62 |

* cited by examiner

*Primary Examiner* — Robert Canfield
(74) *Attorney, Agent, or Firm* — Botkin & Hall, LLP

(57) ABSTRACT

A force resistant panel system is provided where a window pane is bordered by a sash and magnetically attracted to an exterior flange. The exterior flange is attached to an opening in a wall, facing outward. An interior flange with a channel is attached to the inside and facing inward. The exterior flange and interior flange combine to form a channel for which the window pane can travel in the event of a blast. Decorative trim snaps into a groove on the interior flange and generates static outward pressure against the sash.

19 Claims, 4 Drawing Sheets

FORCE-RESISTANT PANEL

CROSS REFERENCE TO RELATED APPLICATIONS

This application claims the benefit of U.S. Provisional Application No. 61/825,574, filed May 21, 2013, the disclosures of which are hereby incorporated by reference.

BACKGROUND OF THE INVENTION

Buildings have traditionally been engineered to withstand the environmental forces expected in the region in which they reside. For example, a building in California might be designed to withstand earthquakes while a building in Florida might be designed to withstand hurricanes. However, the stresses a building might be expected to withstand in its lifetime are no longer limited to natural phenomena, but now include the possibility of acts of terror. As such, protection against the forces associated with explosions is necessary for some buildings which might be the targets of such acts of terror.

One common defense against explosions has been to prevent access to the target building. One way to prevent access to a building is to increase the setback from the building. The setback is measured as the distance of access to a building. Setback can be effective since explosive force is related to distance—the greater the distance an explosive force travels, the lessor the force experienced by the building during a blast. For example, some high-profile buildings have barriers erected around the perimeter of the building which prevent automobiles from driving up to the building. Since automobiles are often used to carry explosives, placing barriers around a building can help to minimize the effect if the explosives are detonated. Unfortunately, in some cases adequate setback is not possible. For example, historical buildings, especially historical government buildings, are often prime targets for terrorist activities, and often are positioned immediately adjacent a street. As such, in some cases setback alone is insufficient to protect a building.

The most vulnerable part of a building during a blast is typically the windows, as the glass on windows will shatter during an explosion, the sharp pieces becoming high-speed projectiles in the building. It is costly to retrofit an existing building with explosion-resistant glass, and typically involves expensive reinforcement and reengineering of the window sills. Such a retrofit typically requires use of the building be suspended or altered during construction.

Previous force-resistant panels have been provided which are anchored to the window sill at the upper and lower ends, leaving the middle portion of the window movable during a blast. In such designs, as viewed in vertical cross-section, the panel bends in a parabolic shape during a blast. In such designs, a parabolic-shaped stop is built on the window sill to catch the panel as it bends. Such designs are insufficient due to the cost and complexity of building the parabolic stop and the stresses related to the bending of the window. Such designs are also insufficient due to the stresses on the building at the sills where the panels are anchored. Further, deformation of the panels during a blast can be non-uniform, causing the panel to improperly engage the stop and come free during a blast. An improved blast panel is needed.

SUMMARY OF THE INVENTION

The present disclosure describes a blast panel which is suitable for being retrofit into an existing window sill and spaced interiorly from an existing window pane. The blast panel described herein is movable, such that during an explosion, the panel will move toward the interior of the building, translating the explosive force of the blast into kinetic movement of the panel, thereby reducing the stresses on the building, and limiting damage inside the building.

The blast panel of the present disclosure includes a sash which is adapted for carrying a glass or composite pane. The sash includes an extension member extending from the interior face (the face of the sash facing the interior of the building) of the sash, the extension member spanning the perimeter of the sash. A magnet is affixed to the exterior face of the sash. A stop is affixed to the window sill, with the stop having an exterior portion and an interior portion. The exterior portion of the stop is characterized by a member extending perpendicularly from the sill and positioned toward the exterior portion of the building relative the sash. The exterior portion of the stop is preferably formed from a ferromagnetic material, such that the sash is held to the exterior portion of the stop by the magnet. The interior portion of the stop is formed having a slot positioned interiorly relative the extension member of the sash. A stop cover extends between the sill and the sash, thereby concealing the interior portion of the stop and biasing against the sash to hold the sash against the exterior portion of the stop.

BRIEF DESCRIPTION OF THE DRAWINGS

A preferred embodiment of this invention has been chosen wherein.

DESCRIPTION OF THE PREFERRED EMBODIMENT

Figure 1:
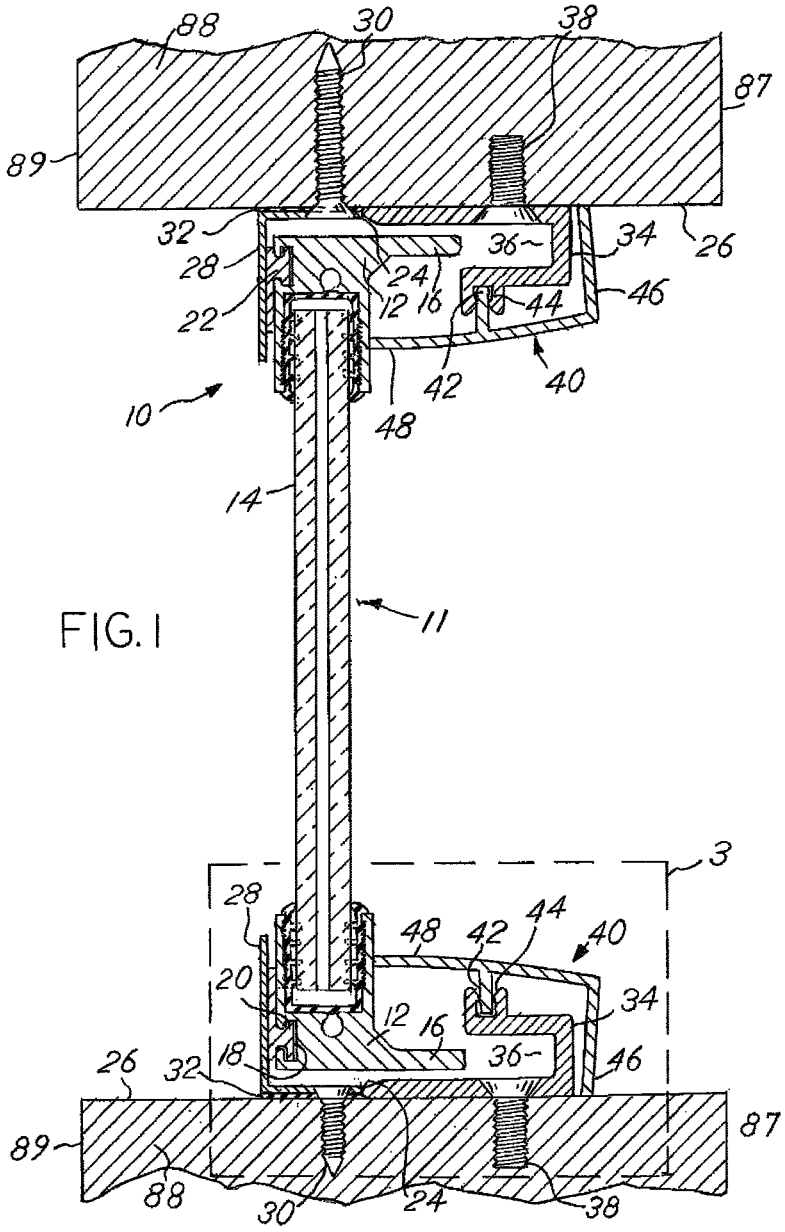
FIG. 1 is a cross-sectional vertical view of a force resistant panel, a horizontal section view being the same.

The present disclosure describes a force-resistant panel system 10 as shown in FIG. 1 which is designed to mitigate the effects of a blast 100 or explosion to the windows of a building. As used herein, "exterior" generally refers directionally to the side of the force-resistant panel system 10 which faces the outside of the building, and "interior" generally refers directionally to the side of the force-resistant panel system 10 which faces the inside of the building. While the typical installation involves an exterior window to a building, it can be installed in any wall where it is possible an explosion can come from one side. The building wall 88 has an interior surface 87 and an exterior surface 89, with a window opening. The window opening is bordered by a sill 26, which is a surface that connects the interior surface 87 and the exterior surface 89. The sill 26 can be part of the window panel system that is installed as a unit into a wall 88.

Figure 2:
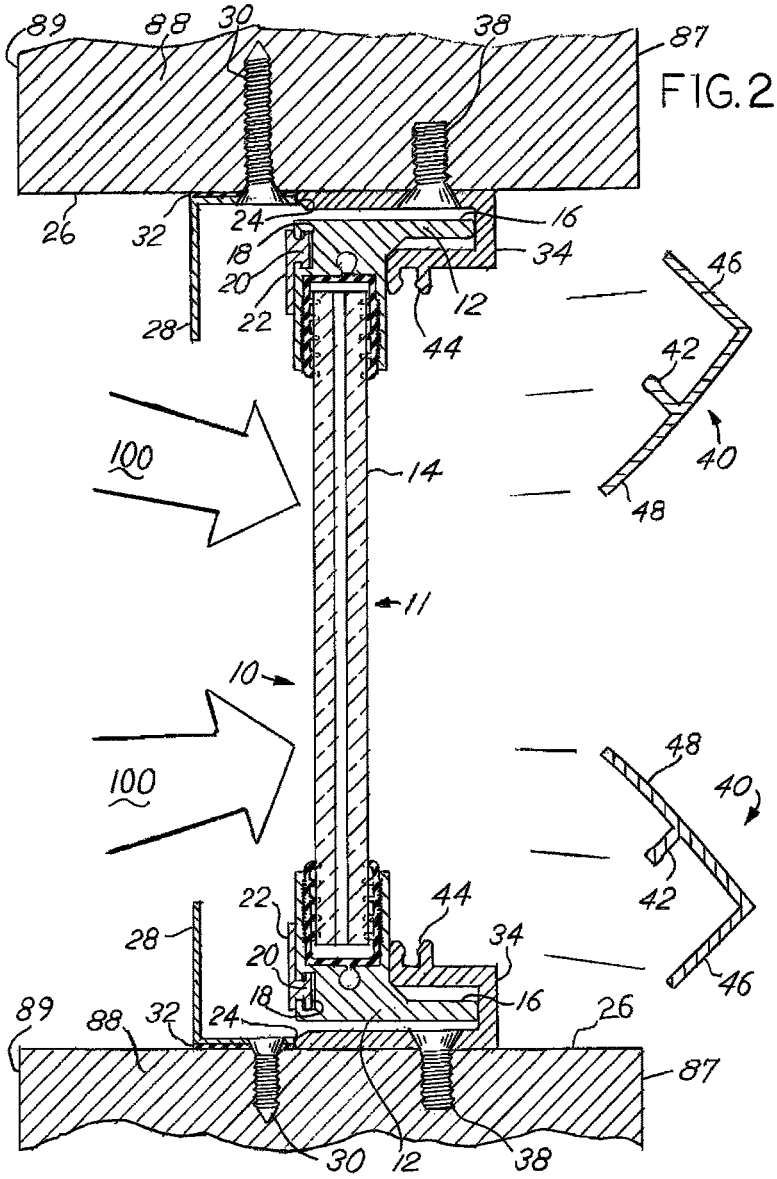
FIG. 2 is a cross-sectional vertical view of the force resistant panel shown following an explosion, a horizontal section view being the same.
Figure 3:
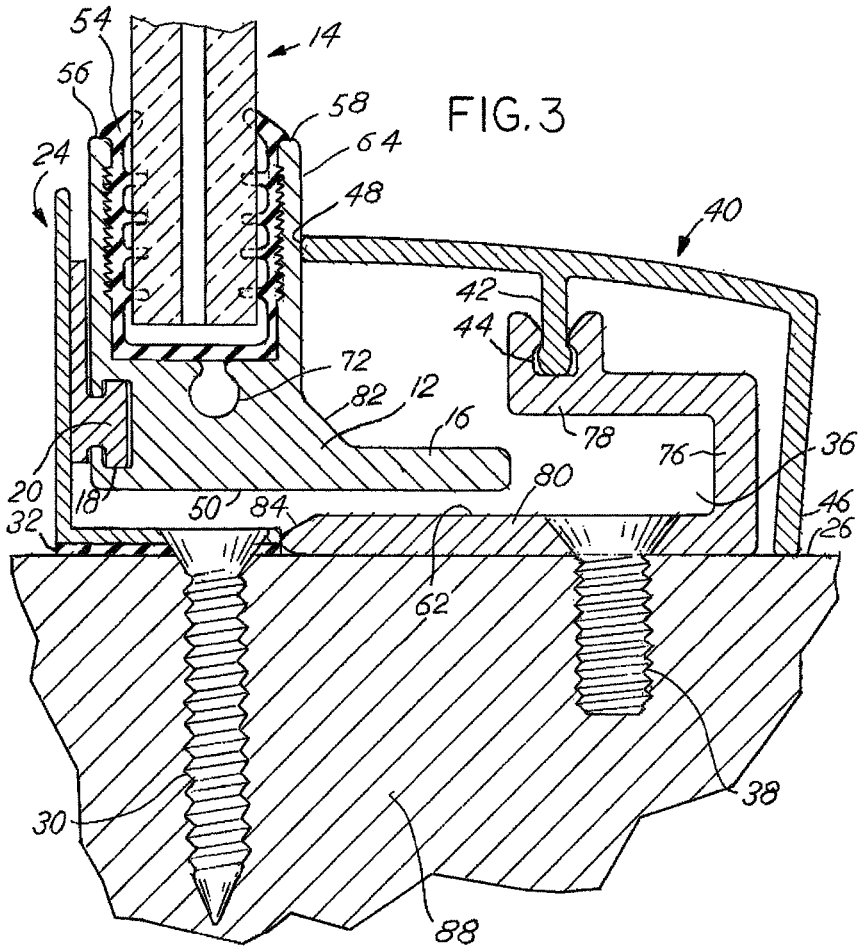
FIG. 3 is a partial cross-sectional view 3 of the force resistant panel in FIG. 1.
Figure 5:
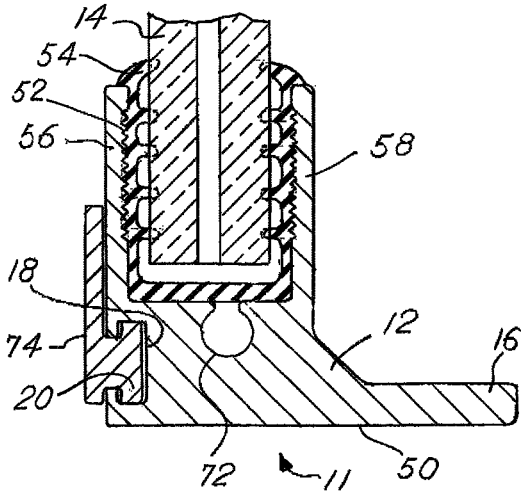
FIG. 5 is a view of the sash in section 3 of the force resistant panel in FIG. 1.

The system 10 shown in FIG. 1 includes a window 11 with a sash 12 which surrounds the perimeter of a pane 14. Pane 14 is a window pane, such as formed from glass, plastic, or a composite, preferably formed from a material suitable for withstanding the forces associated with a blast 100. The pane 14 is typically a flat planar surface with a perimeter. The pane 14 as shown is double-paned; other styles and number of panes are possible. The sash 12 as shown in FIG. 5 is formed from an aluminum extrusion with a groove formed from parallel upstanding walls 56, 58 for receiving a window gasket 54. The interior surfaces of the upstanding walls 56, 58 have ridges 52 to retain the gasket 54. Between upstanding walls 56, 58, is a slot 72 for receiving a screw. Where sides of the sash 12 meet, the extrusion is cut at a 45° angle to form the mating surfaces of a corner. A hole is drilled in the adjacent/perpendicular sash member that is inline with the slot 72. The slot 72 is adapted to receive a self-tapping screw as is commonly known in the art. A screw is inserted through the drilled hole and engages with the slot to affix the adjacent sash members. The gasket 54 fits between upstanding walls 56, 58 and is adapted to receive window pane 14. It is possible that the pane 14 is secured to the sash 12 through adhesive, silicone, or other method instead of a gasket. The sash 12 includes an extension member 16 extending towards the interior surface 87 and parallel to the sash 12. As shown in FIGS. 1 and 2, extension member 16 extends from both the horizontal and vertical interior faces of the sash 12. The extension member 16 extends interiorly relative to the sash 12 and generally perpendicular to the pane 14 and includes a perimeter surface 50, FIGS. 3 and 5. As shown in FIGS. 1 and 2, a groove 18 in the exterior face of the sash 12 is adapted to receive a tongue 20 of a magnet 22. The magnet 22 overlies a portion of the exterior face of the sash 12, and is held to the sash 12 by the fit between the tongue 20 and groove 18. In the embodiment as shown in FIGS. 3 and 5, the tongue 20 is a protrusion and groove 18 is a channel that is adapted to receive the tongue 20. The magnet 22 is alternatively held to the sash 12 by adhesive, fasteners, or other means as are known in the art. The magnet 22 is charged to attract a ferromagnetic metal to the mating surface 74.

Figure 4:
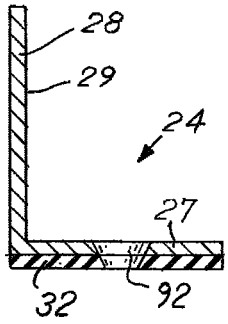
FIG. 4 is a view of the exterior stop in section 3 of the force resistant panel in FIG. 1.

An exterior stop 24 as shown in FIG. 4 is part of the system 10 and is fastened to the sill 26 as shown in FIGS. 1 and 2. The exterior stop 24 serves to hold the sash 12 towards the exterior surface 89 and limits the movement of the window 11 in the exterior direction. The exterior stop 24 includes an exterior lip portion 28 and a wall portion 27 to form an L-shaped member. The lip portion 28 and wall portion 27 will be referred to hereinafter as lip 28 and wall 27. The exterior lip 28 has an interior facing surface 29 as shown in FIG. 4. The exterior stop 24 is secured to the sill 26 by a fastener 30 through wall 27. As installed on the sill 26, the exterior lip 28 extends perpendicularly therefrom. Exterior lip 28 is preferably formed from a ferromagnetic material, such as angle iron or stamped steel, to allow the magnet 22 to hold the sash 12 to the exterior lip 28. An adhesive tape or dispensed adhesive 32 between wall 27 and sill 26 is optionally used to hold the exterior lip 28 to the sill 26 during installation prior to the fastener 30 being inserted through wall 27 to simplify installation of the system 10. The adhesive 32 also prevents or reduces air infiltration. The window 11, specifically the distance between opposing perimeter surfaces 50 FIG. 5 is smaller than the distance between opposing walls 27 to compensate for size variations, sill irregularity, thermal expansion, and building movement. The gap formed between the sash 12 and the wall 27 is visible in FIG. 4, allowing for limited movement. As shown in FIGS. 1 through 5, fastener 30 is a countersink head fastener, fitting into a complementary countersink hole in the exterior stop 24. The exterior lip 28 is held to the sill 26 by a fastener 30. In the event that the system 10 is a pre-assembled unit, the sill 26 is a separate unit and fastener 30 would be driven into the sill 26.

Figure 6:
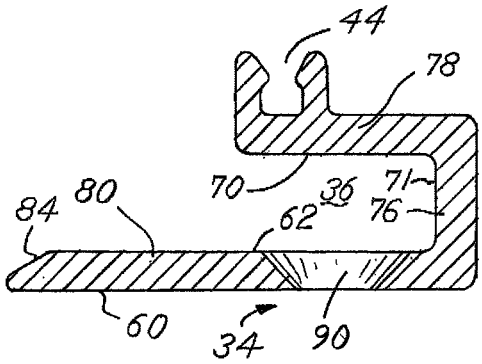
FIG. 6 is a view of the internal stop in section 3 of the force resistant panel in FIG. 1.

An interior stop 34 as shown in FIG. 6 has a lower portion 80, a bridge portion 76, and an upper portion 78. At the tip of the upper portion 78 is a groove 44. The lower portion 80, bridge portion 76, and upper portion 78 combine to form a channel 36 which is sized to accept the extension 16. The channel 36 is an interior groove formed by an upper surface 62 of the lower portion 80, an exterior facing surface 71 of the bridge portion 76, and a lower surface 70 of the upper portion 78. The lower portion 80 has a ramped surface 84 where it abuts exterior stop 24. The ramped surface 84 is a guide that generates a gradual transition between the interior surface of the exterior stop and the sliding surface 62 of the mounting portion 80. The mounting portion 80 abutting an interior facing edge on wall 27 of the exterior stop 24 locates the channel interiorly from window 11, however it is possible to locate the channel 36 without contacting the exterior stop 24. By contacting the wall 27 with the interior stop 34, the distance between the channel 36 and the extension is controlled. The channel 36 is designed to receive extension member 16 and allow inward travel in the event mating surface 74 FIG. 5 moves away from exterior lip 28. An access hole (not shown) through the upper portion 78 is large enough to pass the entire fastener 38 and allow access to install fastener 38 to affix the interior stop 34 to the sill 26. In the embodiment shown in all FIGS, the fastener 38 is a countersink design such that the top surface of fastener 38 is flush with the upper surface 62. The countersink design is used to prevent the fastener 38 from protruding into the channel 36. In the event that the system 10 is a pre-assembled unit, the sill 26 is a separate unit and fastener 38 would be driven into the sill 26. The system 10 as installed on a sill 26 has a distance between opposing upper surfaces 62 that is greater than opposing perimeter surfaces 50 to allow for building movement, panel shifting, thermal expansion, and space to move inward without binding during an explosion. This is shown in FIGS. 1 through 3.

A cover 40 as shown in FIGS. 1 and 2 is F-shaped and conceals interior stop 34. The cover 40 has a tongue 42, a sill portion 46, and a sash portion 48. The cover 40 serves several purposes: First, it is decorative and spans between sash 12 and sill 26 to cover interior stop 34. Second, it is releasable in the event of a blast 100 that pushes the window 11 interiorly. Third, it maintains static pressure to the sash 12 thereby maintaining contact between the magnet 20 and the interior facing surface 29 of the exterior stop 28. The tongue 42 is retained in a groove 44 which is formed as part of the interior stop 34. The tongue 42 is an interference/snap fit in the groove 44, thereby holding the cover 40 in place. The tongue 42 as shown in all FIGS. is a tongue that snap fits into the groove formed by groove 44. The visible surface of cover 40 is formed by the sill portion 46, sash portion 48, and the surfaces in-between. The sash portion 48 extends to the sash 12 and the sill portion 46 extends to the sill 26. The cover 40 is formed from a resilient material, such as plastic, such that it has somewhat of a flexible or spring-like quality. The sash portion 48 is in biased contact with the sash 12, thereby resistively pushing the sash 12 against the interior facing surface 29 of the exterior lip 28. The sash portion 48 will flex as the sash 12 moves with thermal expansion or other small movements. If a force (such as from a gust of wind) pushes on pane 14, and is sufficient to overcome the force of the magnet 22, the sash portion 48 will ease the sash back against the exterior lip 28. However, a sufficiently strong force, such as that from an explosion, will cause the sash 12 to travel toward the back of the channel 36, putting significant pressure on the cover 40, causing the sash portion 48 to move inward to the point of forcing the tongue 42 free from the groove 44, which will cause the cover 40 to fall away from the interior stop 34, as shown in FIG. 2. Restoring the system 10 to its original installed condition involves pushing the sash 12 exterior in order to contact magnet 22 to the exterior lip 28 and then reinstalling the cover 40 onto the interior stop 34.

For assembly of the system 10, the exterior stop 24 is positioned and affixed to a sill 26 with adhesive 32 and screws 30. As previously stated, the sill 26 can either be a building wall 88 or a separate piece that resides between the building wall and the system 10. The four sides of the exterior stop 24 are the same for the top, bottom, and sides. The window 11 is built by taking a pane 14, sash 12, magnet 20, and gasket 54 and assembling them into a window assembly. The gasket 54 circumscribes the perimeter of the pane 14, the magnet 20 is installed to the sash, then the sash 12 is installed. The parts for the top, bottom, and sides are the same. Corners are miter cut from the sash extrusion then mated, typically at a 45° angle, then a screw is installed through one side of the corner and into the slot 72 of the adjacent sash extrusion. Screws at each corner hold the sash extrusion parts together to form a continuous sash 12 that circumscribes the window pane 14. The window 11 is placed against the interior facing wall of the exterior stop 24, where the magnet 20 contacts interior facing surface 29 of the exterior lip 28 and attaches thereto. The interior stop 34 is installed with a screw 38 that secures to hole 90. There is a clearance hole (not shown) in the upper portion 78 inline with hole 90 for the screw 38 to pass through. The mounting portion 80 is affixed to the sill 26 abutting exterior stop 24 and extends interiorly from exterior stop 24. The wall 27 of the exterior stop 24 is shown in contact with the interior stop 34 where both are affixed to the sill 26. As with the sash 12 and exterior stop 24, the four sides of the interior stop are the same. Lastly, the cover 40 is snapped into place where the tongue 42 snaps into the groove 44. Because the system 10 uses the same parts for sides, top, and bottom, installation of the panel system 10 is not limited to four-sided openings; it can be used for any opening with three sides or more. As discussed above, the sill 26 can be part of the assembly whereby the system 10 can be installed in one piece into a wall 88.

Explosions include a rapidly-moving high-pressure blast wave 100. The blast wave 100 generally travels faster than the speed of sound. When the blast wave 100 encounters the window 11, the force of the blast wave 100 will overcome the magnetic force of magnet 20, causing it to come free from the exterior lip 28 and the window 11 will begin moving in the direction of the interior stop 34. The blast wave 100 will pass through the pane 14 faster than the pane will travel between the exterior lip 28 and the interior stop 34. All four perimeter sides of the pane 14 move during a blast; the pane 14 is held against exterior lip 28 by the magnets 22 and the biasing force of the cover 40. During a blast, all four perimeter sides of the pane 14 are movable, with no side anchored to the sill 26, thereby limiting the force transferred to the sill 26 during a blast. No part of the sash 12 remains in contact with the exterior lip 28. Also, since the entire window 11 is movable during a blast, the pane will be less susceptible to bending during a blast. The interior stop 34 and exterior stop 24 form a space that locates the sash such that during an explosion, the explosive force 100 pushes the sash 12 away from exterior lip 28 and the extension 16 moves into the channel 36 thereby limiting the movement of the sash 12 during the explosion, as shown in FIGS. 2 and 3. In this way, the system 10 translates the force from the explosion into kinetic movement of the sash 12 and pane 14. In this way, the blast force is translated to kinetic movement of the pane, thereby reducing the force on the sill of the building. The FIGS. that demonstrate the system absorbing a blast show how the interior stop 34 meets extension 16, but do not show any distortion or flexing in any of the members. In reality, many or all of the components shown in FIG. 2 would distort during and shortly after a blast 100.

It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modifications may be made to the disclosed subject matter as set forth in the following claims.

What is claimed is:

1. A force resistant panel system for installation in a structure, said structure having a wall including an aperture defined by a transverse surface extending between an exterior side and an interior side, and a sill defined by said transverse surface, said panel system comprising:

an exterior stop having a lip portion and a wall portion, said lip portion having an exterior facing surface, and an interior facing surface formed from a material capable of magnetic attraction, said exterior stop being fixed with respect to said sill;

an interior stop having a channel with a lower portion including an upper surface and a lower surface, a bridge portion having an interior facing surface and an exterior facing surface, and an upper portion ending at a terminal end spaced from said exterior facing surface of said bridge portion, said upper portion having an upper surface and a lower surface, an interior of said channel being defined by said lower surface of said upper portion, said exterior facing surface of said bridge portion, and said upper surface of said lower portion, said upper surface of said upper portion having a groove, said exterior facing surface of said bridge portion being located opposite and spaced apart from said interior facing surface of said lip portion, said channel fixed with respect to said sill, said wall portion of said exterior stop in contact with said lower portion of said interior stop to set a distance between said interior facing surface of said lip portion and said exterior facing surface of said bridge portion;

a window panel adapted for being located between said interior facing surface of said lip portion and said terminal end of said upper portion, said panel including a sash circumscribing a window pane, said sash including a material capable of magnetic attraction, and an exterior facing surface and an interior facing surfaced opposite said exterior facing surface, said exterior facing surface adapted for securing to said interior facing surface of said lip portion via magnetic attraction between said sash and said lip portion, said sash including an extension member extending from its interior facing surface adapted for sliding into said channel and contacting said exterior facing surface of said bridge portion when said window panel is dislodged from said interior surface of said lip portion, said window panel movable between a first position and a second position, said first position defined by said exterior facing surface of said sash in contact with said interior facing surface of said lip portion, said second position defined by said extension member in contact with said exterior facing surface of said bridge portion of said interior stop, said window panel moving from said first position toward said second position during a blast, said extension member extending inside said channel when said window panel is detached from said interior surface of said lip portion; and a cover formed from a single unitary member, adapted for being fitted in a portion overlying said extension member and said channel, said cover having a tongue adapted for releasably mating with said groove in said interior stop, said cover in biased contact with said window panel when said tongue is mated with said groove.

2. The force resistant panel system of claim 1, said sash having a perimeter with opposing sides including sliding surfaces substantially perpendicular to said window panel and spaced apart by a first distance, said sill having opposing sides with corresponding opposing interior stops fixed thereto, said opposing interior stops having corresponding opposing lower portions with corresponding upper surfaces spaced apart by a second distance, said first distance being smaller than said second distance to form a gap between opposing upper surfaces of corresponding opposing lower portions.

3. The force resistant panel system of claim 2, wherein said extension member includes a distal end being spaced from said interior facing surface of said sash, said distal end contacting said exterior facing surface of said bridge portion before said terminal end of said upper portion contacts said sash when said sash is dislodged from said exterior stop.

4. The force resistant panel system of claim 3, said cover released from said groove when said window panel is dislodged from said interior surface of said exterior stop.

5. The force resistant panel system of claim 1, said sill having three or more sides, each of said sides including an exterior stop and an interior stop, said sash having the same number of sides, each side of said sash being identical.

6. The force resistant panel system of claim 5, said sash having a perimeter with opposing sides including sliding surfaces substantially perpendicular to said window panel and spaced apart by a first distance, said sill having opposing sides with corresponding opposing interior stops fixed thereto, said opposing interior stops having corresponding opposing lower portions with corresponding upper surfaces spaced apart by a second distance, said first distance being smaller than said second distance to form a gap between opposing upper surfaces of corresponding opposing lower portions.

7. The force resistant panel system of claim 6, wherein said extension member includes a distal end being spaced from said interior facing surface of said sash, said distal end contacting said exterior facing surface of said bridge portion before said terminal end of said upper portion contacts said sash when said sash is dislodged from said exterior stop.

8. The force resistant panel system of claim 7, said cover released from said groove when said window panel is dislodged from said interior surface of said exterior stop.

9. The force resistant panel system of claim 8, said sash having a groove on said exterior facing surface, said magnet having a tongue mated with said groove.

10. A force resistant panel system for installation in a structure, said structure having a wall including an aperture defined by a transverse surface extending between an exterior side and an interior side, and a sill defined by said transverse surface, said panel system comprising:

an exterior stop having an interior facing surface formed from a material capable of magnetic attraction, said stop being fixed with respect to said sill;

an interior stop having a channel with a lower portion including an upper surface, a bridge portion having an exterior facing surface, and an upper portion ending at a terminal end spaced from said exterior facing surface of said bridge portion, said upper portion having an upper surface and a lower surface, an interior of said channel being defined by said lower surface of said upper portion, said exterior facing surface of said bridge portion, and said upper surface of said lower portion, said upper surface of said upper portion having a groove, said exterior facing surface of said bridge portion being located opposite and spaced apart from said interior facing surface of said exterior stop, said channel fixed with respect to said sill, said exterior stop in contact with said interior stop to set a distance between said interior facing surface of said exterior stop and said exterior facing surface of said bridge portion;

a window panel adapted for being located between said interior facing surface of said exterior stop and said terminal end of said upper portion, said panel including a sash circumscribing a window pane, said sash including a material capable of magnetic attraction, and an exterior facing surface and an interior facing surface, said exterior facing surface adapted for securing said sash to said exterior stop via magnetic attraction between said sash and said exterior stop, said sash including an extension member extending from said interior facing surface of said sash adapted for sliding into said channel when said window panel is dislodged from said interior surface of said exterior stop, said window panel movable between a first position and a second position, said first position defined by said exterior facing surface of said sash in contact with said interior facing surface of said exterior stop, said second position defined by said extension member in contact with said exterior facing surface of said bridge portion of said interior stop, said window panel movable from said first position to said second position during a blast, said extension member extending inside said channel whenever said window panel is detached from said interior surface of said exterior stop; and a cover formed from a single unitary member, adapted for being fitted in a portion overlying said extension member and said channel, said cover having a tongue adapted for releasably mating with said groove in said interior stop, said cover in biased contact with said window panel when said tongue is mated with said groove.

11. The force resistant panel system of claim 10, said sill having three or more sides, each of said sides including an exterior stop and an interior stop, said sash having the same number of sides, each side of said sash being identical.

12. The force resistant panel system of claim 11, said sash having a perimeter with opposing sides including sliding surfaces substantially perpendicular to said window panel and spaced apart by a first distance, said sill having opposing sides with corresponding opposing interior stops fixed thereto, said opposing interior stops having corresponding opposing lower portions with corresponding upper surfaces spaced apart by a second distance, said first distance being smaller than said second distance to form a gap between opposing upper surfaces of corresponding opposing lower portions.

13. The force resistant panel system of claim 12, wherein said extension member includes a distal end being spaced from said interior facing surface of said sash, said distal end contacting said exterior facing surface of said bridge portion before said terminal end of said upper portion contacts said sash when said sash is dislodged from said exterior stop.

14. The force resistant panel system of claim 13, said cover released from said groove when said window panel is dislodged from said interior surface of said exterior stop.

15. A force resistant panel system for installation in a structure, said structure having a wall including an aperture defined by a transverse surface extending between an exterior side and an interior side, and a sill defined by said transverse surface, said panel system comprising:

an exterior stop formed from a material capable of magnetic attraction, said stop being fixed with respect to said sill;

an interior stop having a channel with a lower portion including an upper surface, a bridge portion having an exterior facing surface, and an upper portion ending at a terminal end spaced from said exterior facing surface of said bridge portion, said upper portion having a lower surface, an interior of said channel being defined by said lower surface of said upper portion, said exterior facing surface of said bridge portion, and said upper surface of said lower portion, said exterior facing surface of said bridge portion being located opposite and spaced apart from said interior facing surface of said exterior stop, said channel fixed with respect to said sill, said exterior stop in contact with said interior stop to set a distance between said interior facing surface of said exterior stop and said exterior facing surface of said bridge portion; and a window panel adapted for being located between said interior facing surface of said exterior stop and said terminal end of said upper portion, said panel including a sash circumscribing a window pane, said sash including a material capable of magnetic attraction adapted for securing to said exterior stop via magnetic attraction between said sash and said exterior stop, said sash including an extension member opposite its exterior facing surface adapted for sliding into said channel and contacting said interior surface of said bridge portion when said window panel is dislodged from said exterior stop, said window panel movable between a first position and a second position, said first position defined by said sash in contact with said exterior stop, said second position defined by said extension member in contact with said exterior facing surface of said bridge portion of said interior stop, said window panel movable from said first position to said second position during a blast, said extension member extending inside said channel whenever said window panel is detached from said exterior stop.

16. The force resistant panel system of claim 15, said terminal end of said upper portion having a groove, a cover formed from a single unitary member, adapted for being fitted in a portion overlying said extension member and said channel, said cover having a tongue adapted for releasably mating with said groove in said interior stop, said cover in biased contact with said window panel when said tongue is mated with said groove.

17. The force resistant panel system of claim 16, wherein said extension member includes a distal end being located opposite said exterior facing surface of said sash, said distal end connecting said exterior facing surface of said bridge portion before said terminal end of said upper portion contacts said sash when said sash is dislodged from said exterior stop.

18. The force resistant panel system of claim 17, said sill having three or more sides, each of said sides including an exterior stop and an interior stop, said sash having the same number of sides, each side of said sash being identical.

19. The force resistant panel system of claim 18, said window panel movable between a first position and a second position, said first position defined by said exterior facing surface of said window panel in contact with said interior facing surface of said exterior stop, said second position defined by said extension member in contact with said exterior facing surface of said bridge portion of said interior stop, said window panel movable from said first position to said second position during a blast.

* * * * *